US005173672A

United States Patent [19]

Heine

[11] Patent Number: 5,173,672

[45] Date of Patent: Dec. 22, 1992

[54] DIELECTRIC BLOCK FILTER WITH INCLUDED SHIELDED TRANSMISSION LINE INDUCTORS

[75] Inventor: David R. Heine, Albuquerque, N. Mex.

[73] Assignee: Motorola, Inc., Schaumburg, Ill.

[21] Appl. No.: 733,585

[22] Filed: Jul. 22, 1991

[51] Int. Cl.[5] ..... H01P 1/202

[52] U.S. Cl. ..... 333/206; 333/202

[58] Field of Search ..... 333/202, 206, 207, 222, 333/223, 32, 33

[56] References Cited

U.S. PATENT DOCUMENTS 4,740,765 4/1988 Ishikawa et al. ..... 333/202 X

FOREIGN PATENT DOCUMENTS 0179603 8/1986 Japan ..... 333/222

0019001 1/1990 Japan ..... 333/206

*Primary Examiner*—Eugene R. LaRoche

*Assistant Examiner*—Seung Ham

*Attorney, Agent, or Firm*—Joseph P. Krause

[57] ABSTRACT

In those monolithic ceramic filters that require resonator stages formed within a block of dielectric material to be electrically coupled together through discrete components, namely wires (44 and 46), a substantial space savings as well as improved electrical and mechanical performance can be realized by mounting the wires (44 and 46) within de-coupling cavities (36 and 40) when such de-coupling cavities are available and properly positioned with respect to the other resonator elements in the filter.

16 Claims, 1 Drawing Sheet

DIELECTRIC BLOCK FILTER WITH INCLUDED SHIELDED TRANSMISSION LINE INDUCTORS

FIELD OF THE INVENTION

This invention relates to electrical signal filters. More particularly this invention relates to multistage ceramic block filters.

BACKGROUND OF THE INVENTION

Dielectric block filters are well known in the art. In general, dielectric block filters are comprised of a monolithic block of ceramic or other dielectric material, through which holes are formed, the interior surfaces of which are then plated with a conductive material. The exterior surfaces of the monolithic block are also typically coated with conductive material, with the exception of one surface of the block through which the holes within the block extend.

The coated, metallized surfaces within the holes through the block, by virtue of the physical dimensions of the block permitting an appropriate length of metallization within the hole, form quarter-wavelengths of transmission line, of which, one end of which is shorted to the metallization on the exterior surfaces of the block. These short-circuited quarter-wavelength transmission lines form resonators having relatively high Q and comprised tuned elements of a dielectric block filter.

In many applications for dielectric block filters, multiple resonator stages formed by these shorted lengths of transmission line are to be electrically connected together, typically in series with other resonator but also possibly in parallel. At the same time that such stages are to be connected together, in many applications it is desirable to electrically isolate the resonator stages from each other to reduce undesired signals in one stage from being coupled into a succeeding stage. In these applications, the resonators comprising these stages require coupling to one another, typically through either discrete lengths of wire soldered to coupling pads on the top of the block near the open circuit end of these transmission lines or by means of printed patterns on top of the monolithic block of material.

As stated above, coupling resonator stages together has previously been accomplished largely using lengths of wire or lumped inductor elements. In using a length of wire to couple resonator sections together, cross talk between the resonator stages and signals on the wires typically occurs, which can severely degrade the filter's performance. Futhermore, lengths of wire that are physically attached to connection pads on the top of the block are susceptible to physical dislocation and disconnection by virtue of the fact that the lengths of wire are exposed to the external environment around them.

SUMMARY OF THE INVENTION

There is provided a monolithic ceramic block filter comprised of a block of dielectric material having a plurality of holes formed in the block that extend completely through it. The interior surfaces of the holes are coated with a metallization layer that forms resonator stages through the block of material. Isolator stages, which are themselves metallized holes formed in the block of material and that are physically located between resonator stages, have inserted in them, lengths of wire that couple resonator stages formed within the block of dielectric material and that would otherwise be physically above the block, radiating signals and susceptible to physical abuse. The isolation stages which have these lengths of wire enclosed within the holes provide electrical shielding to signals on the lengths of wires and also mechanically shield the wire from physical dislocation that would be likely by having the length of wire freely mounted or exposed on one or more surfaces of the dielectric block.

DESCRIPTION OF A PREFERRED EMBODIMENT

Figure 1:
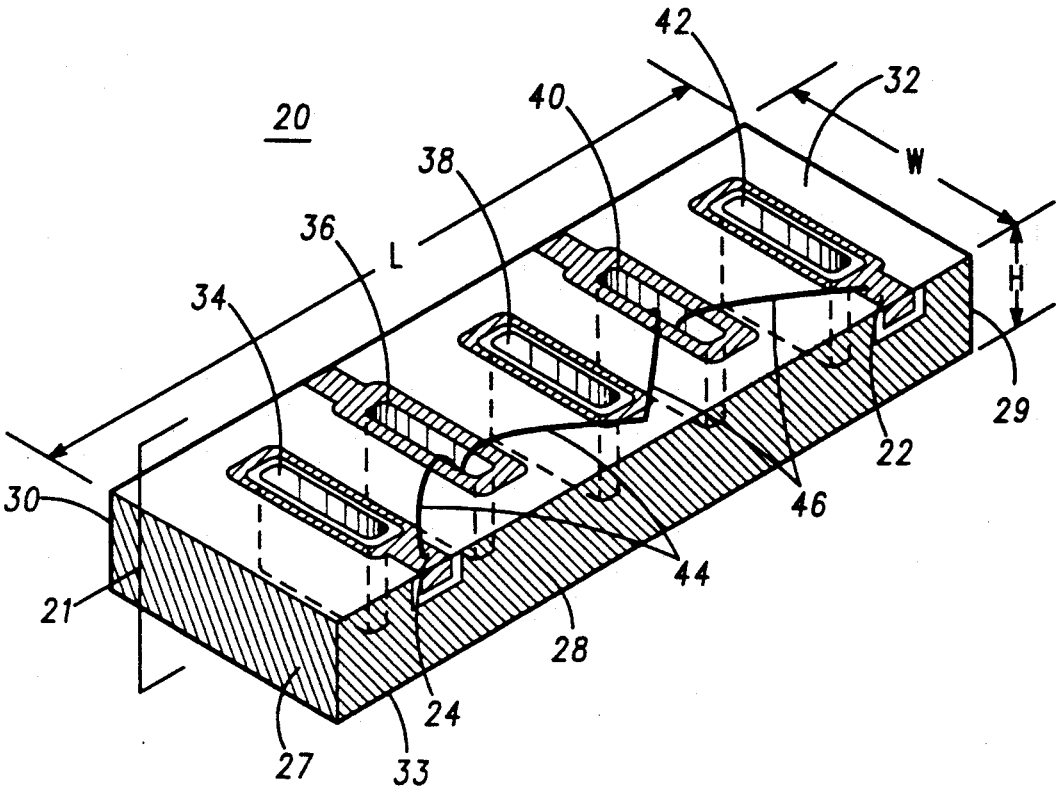
FIG. 1 shows a perspective view of a block of dielectric material having a plurality of holes formed therein, and also showing the connection of lengths of wire that are mounted within de-coupling cavities.

FIG. 1 shows a monolithic dielectric block filter (20) that in the embodiment shown, electrically is notch filter, suppressing all frequencies except those between it's upper and lower cutoff frequencies $F_1$ and $F_2$. The filter shown in FIG. 1 is comprised of a block of dielectric material (21) having at least 6 substantially planar external surfaces, which in the preferred embodiment was a parallelpiped. (27, 28, 29, and 30 are the vertical faces of the block. (The top surface is identified by reference number 32 and the bottom surface is identified by reference number 33 but the surface itself is not shown.) The block (21) has a height H, a length L as shown, and a width W, as shown.

The embodiment shown in FIG. 1, includes five, substantially elliptically-cross-sectioned holes (34, 36, 38, 40, and 42,) formed within the block (21), each of which extend completely through the height of the block and each with openings on both the top of the block (32) and the bottom of the block (33).

With the exception of the top surface (32) of the block, all the exterior planar surfaces of the block are covered with a conductive coating and are considered as such to be metallized in that the coating on these surfaces is electrically conductive and forms an electrical shield as well as a reference or ground plane for electrical signals in the block.

Three of these holes, namely the first (34), the middle (38), and the third (42) have interior surfaces metallized but which are coupled to the exterior metallization on the exterior planar surfaces at only the lower end (33) of the block. As such these three holes (34, 38, and 42) form shorted transmission lines by virtue of the metallization lining the interior surface of these holes that is coupled to the metallization on the exterior surface of the block at only the lower end or the lower face (33) of the block (21). Electrical signals are coupled to the first of these holes (34) by means of an input pad (22) that is metallization on a portion of the top surface as shown. Electrical signals are coupled to and from the first hole (34) by means of the layer of conductive material (metallization) (24) that surrounds the hole (34) and that also extends around the corner formed by the intersection of the top side (32) and the front side (28) to form an input-/output pad on the front side (28). A second input-output means is comprised of the metallization (22) that surrounds the fifth hole (42) and wraps around the same corner. These input-output ports are typically at least single layers of metallization deposited onto the block least capacitively couple signals into and out of the resonators within the block (21).

Coupled between these resonators (formed by the metallization within the holes (34, 38, and 42) are isolators that are metallized holes (36 and 40) between the resonator stages. These isolators, which are metallized holes shorted to the metallization on the exterior surfaces of the block (21) at both the top surface (32) and the lower surface (33), suppress capacitive coupling between the resonator stages and are also holes having substantially elliptical cross sections. It should be pointed out that these isolators formed by the metallization on the interior surfaces of holes (36 and 40) are coupled to the exterior metallization on the faces of the block (21) at both their upper ends near the top surface (32) as well as being coupled to ground at the bottom end (33) thereby approximating electrical shields between the resonator stages. Transmission line inductors (44 and 46) that couple the resonator stages together and which as shown in FIG. 1 are merely wires, provide a signal path between the resonator stages.

Figure 2:
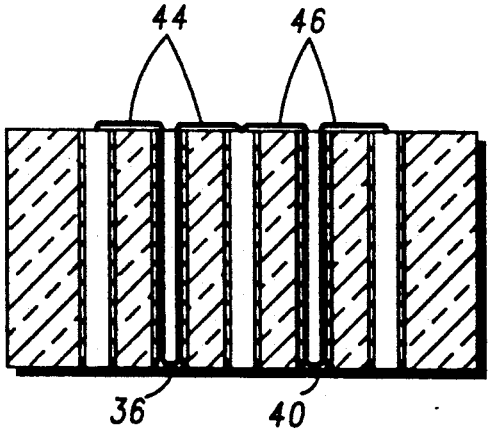
FIG. 2 shows a cross-sectional diagram of the apparatus shown in FIG. 1.

Referring to FIG. 2 can be seen that the wires (44 and 46) are coupled to the top ends of the resonator stages (34, 38, and 42) and extend into the volume enclosed by the isolators formed by the holes (36 and 40). As such, these wires are at least partially enclosed within the holes (36 and 40). The physical lengths of these wires that form these transmission line inductors are selected such that at a particular frequency, they have an electrical length, which including the distributed capacitance between these wires and the grounded metallization lining the two de-coupling cavity holes (36 and 40) provide an impedance inverter. (A quarter wavelength transmission line.) In some applications, instead of using wires, electrical components, such as resistor, capacitor, inductors, or even semi-conductors, might be positioned within the holes (36 and 40) wherein such devices would be electrically shielded and would use space that might otherwise be wasted.

It is well known in the art that a one-quarter wavelength transmission line behaves as an impedance inverter. A sending end impedance of a quarter wavelength transmission line will be substantially equal to the inverse at the far end or receiving end of the transmission line. If a far end of a quarter wavelength transmission line is shorted to ground, or at zero ohms, it's sending impedance would be virtually equal to infinity. A quarter wavelength transmission line that is open circuited at the far end will have a sending end impedance of substantially 0 ohms.

In the preferred embodiment the length of wire (44 and 46) enclosed within the de-coupling cavity holes (36 and 40) provides an impedance inverter that in combination with the topology of the other resonator elements produces a dielectric block filter that has a notch filter response. By virtue of the topology of the shorted resonators comprised of the holes and the isolation of the successive stages, the impedance inversion that takes place in the several stages provides a notch or band-reject response.

In the preferred embodiment, the block (21) shown in FIG. 1 and 2 was a ceramic material, typically barium titanate or neodymium titanate, although those skilled in the art will recognize that other dielectric materials having suitable dielectric constants might be appropriate as well.

In the preferred embodiment the structure shown in FIG. 1 and 2 was a notch filter response having a notch band between 869 MHz. and 894 MHz. The length of the block was 0.490 inches (1244 millimeters), the width was 0.235 inches (596 millimeters), and the height was 0.530 inches (1346 millimeters). It can be seen in FIG. 1 that the cross section of the holes (34, 36, 38, 40, and 42) are substantially elliptical but might just as well have been circular or rectangular cross sectioned holes as well. These holes which are formed in the block during the initial forming of the ceramic material have substantially parallel center axis. That is, the holes are substantially parallel with respect to each other and run through the entire height of the block as shown.

While a length of wire is shown in FIGS. 1 and 2, the function of which is to provide a length of transmission line that acts as an impedance transformer or an impedance matching network, as described above, it is also conceivable that rather than merely placing a piece of conductive wire that other components might be positioned within the de-coupling cavities (38 and 40) as well. It would be a simple matter to additively position within these de-coupling cavities other circuit elements including certain active components that might be capable of being mounted within them.

In addition to the electrical shielding provided by mounting these transmission lines within the decoupling cavities a certain amount of mechanical shielding is also provided. Mechanical shielding prevents the wires that would otherwise have to be mounted above the top surface of the block to be physically protected from distortion or dislocation that might result from mishandling the device either during use or assembly.

It has been observed that mounting the wires (44 and 46) within these de-coupling cavities also produces an increase distributed capacitance between these wires and the grounded surfaces of the filter (20). It has been observed that this increased distributed capacitance produces a somewhat improved electrical performance and that this distributed capacitance may reduce the physical length of the wires (44 and 46) necessary to produce an electrical length that is substantially equal to a quarter wavelength of the frequency of interest.

What is claimed is:

1. A monolithic ceramic block bandstop filter for suppressing desired frequency electrical signals comprising:

a filter body comprised of a block of dielectric material having predetermined physical dimensions and top and bottom surfaces, and at least one side surface, said filter body having at least first and second holes extending through said filter body, said holes having first ends at the top surface of said block and second ends at said bottom of said block, said holes having predetermined cross-sectional shapes and cross-sectional sizes and extending through the top and bottom surfaces, said filter body and interior surfaces of said first and second holes being substantially covered with a conductive material with the exception of said top surface, said coated interior surfaces of said first and second holes and said filter body respectively forming first and second resonators having first and second electrical lengths which suppress electrical signals of a range of frequencies input to said resonators;

an isolator within said filter body, suppressing capacitive coupling between said first and second resonators, comprised of a third hole extending through said block located between said first and second holes, said third hole having a predetermined cross-sectional shape and cross-sectional size and having a first end at said top surface and a second end at said bottom surface, said third hole extending through the top and bottom surfaces of said block, surface within said third hole being substantially covered with conductive material that is electrically coupled, at both said first and second ends of said third hole, to said conductive material coating surfaces of said filter body forming thereby a conductive surface that substantially isolates electrical signals in said first and second resonators from each other; and at least one transmission line inductor means, at least partially positioned within said third hole, for coupling said first and second shorted coaxial resonators together.

2. The filter of claim 1 where said at least one transmission line inductor means, provides an impedance inverter between said first and second resonators and electrically couples said first and second resonators together.

3. The filter of claim 1 where said at least one transmission line inductor means is comprised of a length of wire, said length of wire having an electrical length substantially equal to the electrical length of said first and second resonators.

4. The filter of claim 2 where said at least one transmission line inductor means is comprised of a length of wire, said length of wire having an electrical length substantially equal to the electrical length of said first and second resonators.

5. The filter of claim 1 where said filter body is comprised of a block of dielectric material having the shape of a parallelpiped.

6. The filter of claim 1 where said first and second holes have substantially circular cross-sectional shapes.

7. The filter of claim 1 where said first and second holes have substantially elliptical cross-sectional shapes.

8. The filter of claim 1 where said first and second holes have substantially parallel center axes.

9. The filter of claim 1 including an input port comprised of an area of conductive material proximate to said to first resonator on said top surface.

10. The filter of claim 1 including an output port comprised of an area of conductive material proximate to said to second resonator on said top surface.

11. The filter of claim 1 including an input port comprised of an area of conductive material proximate to said to first resonator on said side surface.

12. The filter of claim 1 including an output port comprised of an area of conductive material proximate to said to second resonator on said side surface.

13. The filter of claim 1 where said first and second resonators have electrical lengths that are substantially equal to each other.

14. A bandstop filter for suppressing desired frequency electrical signals comprising:

a block of ceramic material having top, bottom, and a plurality of side surfaces, said block having at least first and second holes extending through said block, said holes having first ends at the top surface of said block and second ends at said bottom of said block, said holes extending through the top and bottom surfaces, said block and interior surfaces of said first and second holes being substantially covered with a conductive material with the exception of said top surface, said coated interior surfaces of said first and second holes and said filter body respectively forming first and second resonators having first and second electrical lengths that suppress a range of electrical signal frequencies input to said resonators;

a third hole, between said first and second holes and extending through said block, said third hole having a first end at said top surface and a second end at said bottom surface, said third hole extending through the top and bottom surfaces of said block, the surfaces within said third hole being substantially covered with conductive material that is electrically coupled, at both said first and second ends of said third hole, to said conductive material coating surfaces of said filter body; and at least one length of conductive material, at least partially positioned within said third hole, electrically coupling said first and second resonators together.

15. A bandstop filter for suppressing desired frequency electrical signals comprising:

a block of ceramic material having top, bottom, and a plurality of side surfaces, said block having at least first and second holes extending through said block, said holes having first ends at the top surface of said block and second ends at said bottom of said block, said holes extending through the top and bottom surfaces, said block and interior surfaces of said first and second holes being substantially covered with a conductive material with the exception of said top surface, said coated interior surfaces of said first and second holes and said filter body respectively forming first and second resonators having first and second electrical lengths that suppress a range of electrical signal frequencies input to said resonators;

a third hole, between said first and second holes and extending through said block, said third hole having a first end at said top surface and a second end at said bottom surface, said third hole extending through the top and bottom surfaces of said block, the surfaces within said third hole being substantially covered with conductive material that is electrically coupled, at both said first and second ends of said third hole, to said conductive material coating surfaces of said filter body;

at least one length of conductive material, at least partially positioned within said third hole, electrically coupling said first and second resonators together;

a first input-output means, comprised of at least one layer of conductive material deposited onto said top surface, in a localized region of said top surface, surrounding the opening of said first hole on said top surface, for providing at least a capacitive coupling between said at least one layer and conductive material coating said first hole; and a second input-output means, comprised of at least one layer of conductive material deposited onto said top surface, in a localized region of said top surface, surrounding the opening of said second hole on said top surface, for providing at least a capacitive coupling between said at least one layer and conductive material coating said second hole.

16. A bandstop filter for suppressing desired frequency electrical signals comprising:

a block of ceramic material having top, bottom, and a plurality of side surfaces, said block having at least first and second holes extending through said block, said holes having first ends at the top surface of said block and second ends at said bottom of said block, said holes extending through the top and bottom surfaces, said block and interior surfaces of said first and second holes being substantially covered with a conductive material with the exception of said top surface, said coated interior surfaces of said first and second holes and said filter body respectively forming first and second resonators having first and second electrical lengths the suppress a range of electrical signal frequencies input to said resonators;

a third hole, between said first and second holes and extending through said block, said third hole having a first end at said top surface and a second end at said bottom surface, said third hole extending through the top and bottom surfaces of said block, the surfaces within said third hole being substantially covered with conductive material that is electrically coupled, at both said first and second ends of said third hole, to said conductive material coating surfaces of said filter body; and at least one electrical component, at least partially positioned within said third hole, electrically coupling said first and second resonators together.

* * * * *